United States Patent [19]

Douglas, Jr.

[11] 4,236,716

[45] Dec. 2, 1980

[54] TWO-PLAYER PIVOTED ROD BALL DROP GAME

[76] Inventor: Melvin O. Douglas, Jr., 20-21K Richman Plaza, Bronx, N.Y. 10453

[21] Appl. No.: 33,314

[22] Filed: Apr. 25, 1979

[51] Int. Cl.[3] ..... A63F 7/02; A63F 7/24; A63F 7/26

[52] U.S. Cl. ..... 273/110; 273/115; 273/120 A; 273/357; 273/399

[58] Field of Search ..... 273/110, 119 R, 120 R, 273/118 R, 123 R, 109, 108, 113, 355, 356, 357, 115, 117, 399

[56] References Cited

U.S. PATENT DOCUMENTS

| | | | |
|---|---|---|---|
| 1,163,102 | 12/1915 | Morgan | 273/119 R |
| 1,595,071 | 8/1926 | Carlson | 273/110 |
| 2,248,859 | 7/1941 | Ferreri | 273/110 |
| 3,612,531 | 10/1971 | Barlow | 273/399 X |
| 3,985,360 | 10/1976 | Meyer | 273/109 |

*Primary Examiner*—Richard C. Pinkham
*Assistant Examiner*—Scott L. Brown
*Attorney, Agent, or Firm*—Peter L. Berger

[57] ABSTRACT

A box supports two playing fields which slope downwardly from opposite sides thereof toward a switch bar along the exposed inner side of each field for energizing a "spill" display light at the end of each field when a player fails to score with a ball rolling between two gently sloping cues from dwell notches thereon, upon skillfully opening the handles of the cues that rest on a support, and are connected at their outer ends, which are bent down to rest on the playing field, by one of three dropping the ball into triangularly arranged sockets that are assigned different score values ranging from a minimum to a maximum as the distance from the back of the field increases, with three balls per turn per player, two, for example.

4 Claims, 6 Drawing Figures

FIG. 1
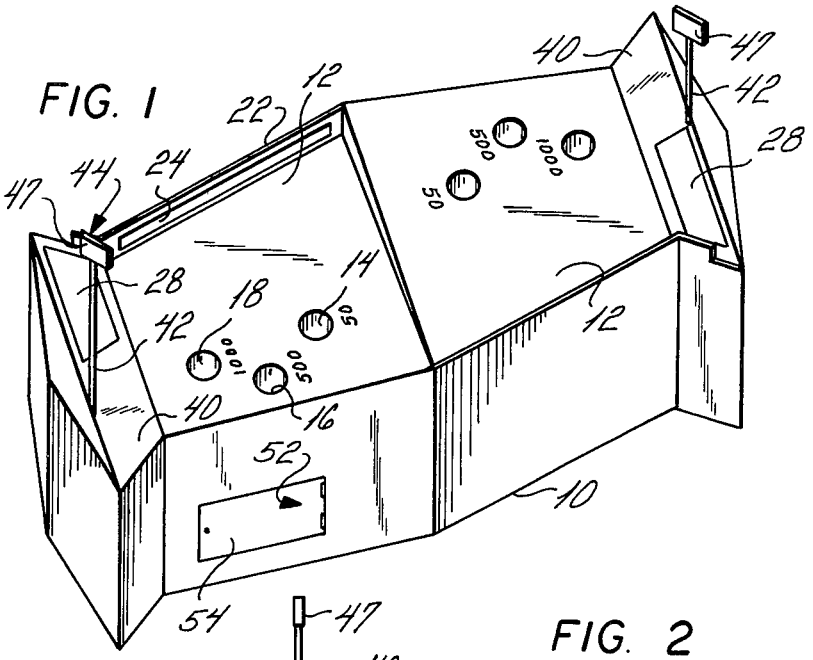
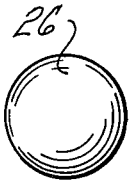
FIG. 5
FIG. 2
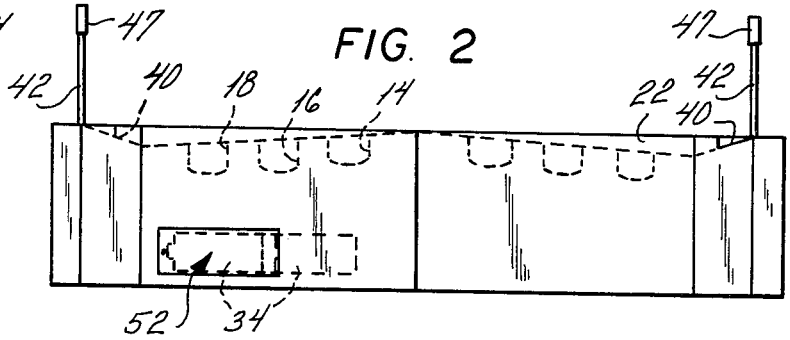
FIG. 4
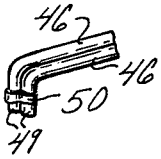
FIG. 3
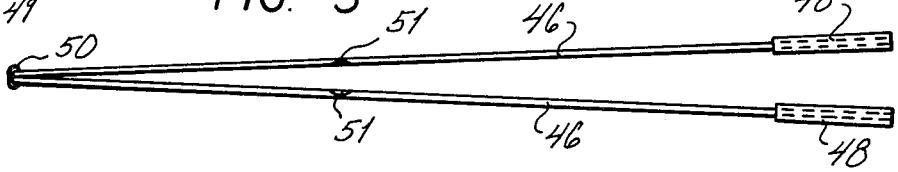
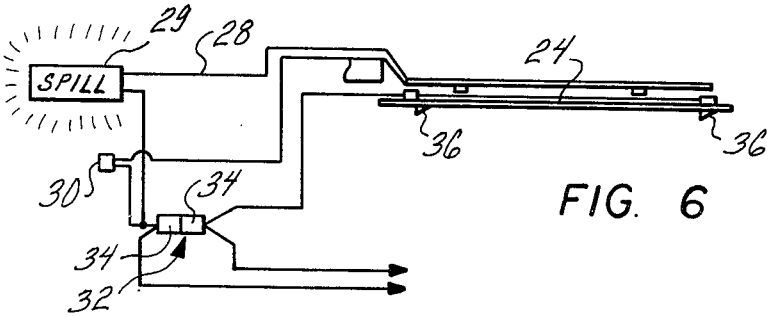
FIG. 6

TWO-PLAYER PIVOTED ROD BALL DROP GAME

PRIOR ART STATEMENT

A search has been conducted and the following patents are submitted herewith.

U.S. Pat. No. 562,264—W. E. Wilcox
U.S. Pat. No. 570,105—T. A. Ryan et al.
U.S. Pat. No. 966,091—S. J. Heinig et al.
U.S. Pat. No. 1,595,071—G. O. Carlson
U.S. Pat No. 3,249,358—E. H. Kessler The present invention distinguishes from the cue stick games illustrated in the above patents by the combination of the cue stick in association with a box-like housing having a top providing two oblong playing fields extending from opposite sides of a transverse center with each field having lateral sloping gradually downwardly and oppositely towards the side wall of the housing exposed by the slope with the pair of cue sticks in association with the slope field enabling the ball to be dropped in respective holes or to roll to the side walls. As a consequence of the sloped platform, the failure of the player to manipulate the cue sticks so that the ball drops in a desired hole on the field will be signaled and electrical signaling means are employed for this purpose. Additionally, pairs of players may simultaneously play on the opposite fields which enhances the appeal and excitement of this game.

BACKGROUND OF THE INVENTION

Game apparatus using two cues between which a ball is rolled are well known.

The main object of this invention is to provide a game apparatus of this type that is more exciting, more interesting, involves score keeping, flashing displays in case of misses, requires considerable dexterity, rests on a table, is simple and inexpensive to construct, and that is relatively light in weight.

SUMMARY OF THE INVENTION

The top of a housing is shaped to provide two oblong surfaces that slope downwardly from opposite sides thereof, and contain three triangularly arranged sockets or holes in the higher areas of such surfaces. The exposed insides of the wall left by the lower edges of the surfaces, are provided with switch bars for energizing lamps behind a SPILL display sign on an upwardly inclined extension at each end of the oblong surfaces. Transverse, horizontal rests are mounted on the top of posts at the end of each laterally sloped surface, with a frame thereon, forming a slot with the corresponding rest. Three balls are used in the game by each of two players, in turn, with a pair of game rods or cues that are supported near their handles on said rest, with the outer ends of such cues connected together by a hinge on the downwardly turned ends of the sticks. A ball is positioned on depressions, or shallow transverse grooves, in the cues about three quarters of the length of the cues from the handle ends, and the handles are moved apart to drop, if successful, the ball into one of the three sockets. If not, the ball rolls laterally and hits the switch bar, causing the SPILL display to flash.

BRIEF DESCRIPTION OF THE DRAWINGS

FIG. 1 is an isometric perspective view of game apparatus embodying the invention.

FIG. 2 is a view in side elevation thereof.

FIG. 3 is a top plan view of the cues in position for receiving a ball.

FIG. 4 is an enlarged fragmentary perspective view of the outer ends of the cues.

FIG. 5 is a top view of a ball used in the game.

FIG. 6 is a fragmentary circuit diagram of the contact bar SPILL display apparatus.

DETAILED DESCRIPTION OF THE INVENTION

Referring to FIG. 1, a box or housing 10 is shaped to provide two oblong playing fields 12,12 on the top thereof. The oblong fields are similar, so only one will be described. The field 12 is provided with cups, holes or sockets 14, 16 and 18 in a triangular arrangement in the higher area of field 12 that is sloped downwardly and laterally, ending at a side wall 22 of the box 10, that is exposed by such slope. The wall 22 is provided with a switch bar 24, which is adapted, when a ball 26, FIG. 5, rolls against it, to close a circuit 28, containing a SPILL lamp 29 a buzzer 30 and a battery 32 of dry cells 34, 34, by closing contacts 36, 36 adjacent the ends of the bar 24. The SPILL display is located on the sloping top 40 of a triangulated extension of housing 10.

Mounted on said sloped extension top 40 is a pole 42 which supports a rest 44 for the cues 46, 46. The rest 44 is covered by a bracket 47 to form with such rest 44, a transverse slot for enclosing the pair of cue sticks 46, 46, near their handles 48, 48. The outer end portions of the cue sticks 46, 46, FIG. 4, are turned down, so that the very ends 49,49 thereof rest on the playing field 12, with the end portions connected together by a hinge 50. The sticks 46, 46 are also provided with corresponding depressions, or slightly curved transverse grooves 51 along the length thereof, for holding a ball thereon to start the game. The battery 32 is located in a compartment 52 in the box 10, having a snap cover 54 for replacing such battery 32. The holes or cups 14, 16 and 18 are labelled in scoring numbers such as 50, 500 and 1000 points as the distance of each hole from the grooves 51 increases.

Since the game is one of dexterity, it is called SKILL-N-SPILL, and is played by two contestants, or by teams of two each. Each player is allowed three balls, there being six provided with the game. One pair of cue rods is used. After placing a ball on the grooved rods resting in the elevated slot, and on the playing field, the rods are raised and/or lowered by their handles to try cause the ball to fall into a hole. Should such attempt fail, causing a SPILL the player must suspend his action until his opponent has completed the game by filling all three holes; or both players must start with a new ball. The game is over when each player, or team, has used all three balls, by "spills" or "fills." A "spilled" ball remains out of play until a new game starts.

I claim:

1. Game apparatus comprising a box-like housing having a top providing two oblong playing fields extending from opposite sides of the transverse center thereof, each field having a lateral sloping gradually downwardly and oppositely toward a side wall of the housing exposed by such slope, a plurality of scoring holes in each field on the higher areas thereof, a pair of cue sticks located above each of said fields, and means hinging together each of said pair of said cue sticks, and connecting each of said pair in a respective field, said cue sticks having corresponding transverse shallow grooves for holding a ball thereon along the length of the sticks, so that the ball may be attempted to be dropped in one of said holes.

2. Game apparatus as defined by claim 1, in which a switch bar is located on the side wall at the bottom of and facing each playing field, an extension having an upwardly sloping top provided at each playing field end, a lamp illuminated display of SPILL located in each extension top, and an electric circuit in the housing including a battery which is energized to light said display by said switch bar when a ball rolls laterally on the corresponding field, and rests against said switch bar.

3. Game apparatus as defined by claim 2, in which said holes are triangularly arranged in each field, and are identified for scoring purposes with numbers of increasing value depending upon their distance from common transverse center of the housing between the fields.

4. Game apparatus as defined by claim 1, wherein said housing comprises a pair of elevated slots, each receiving a respective one of said pairs of cue sticks.

* * * * *